United States Patent [19]

Montagnino

[11] Patent Number: 4,848,007

[45] Date of Patent: Jul. 18, 1989

[54] DIFFUSER ATTACHMENT FOR A HAIR DRYER

[75] Inventor: James G. Montagnino, El Paso, Tex.

[73] Assignee: Helen of Troy Corporation, El Paso, Tex.

[21] Appl. No.: 139,836

[22] Filed: Dec. 30, 1987

[51] Int. Cl.[4] ..... A45D 20/26

[52] U.S. Cl. ..... 34/97; 219/373; 239/419.5

[58] Field of Search ..... 34/97, 96; 239/419.5; 219/373

[56] References Cited

U.S. PATENT DOCUMENTS

| | | | |
|---|---|---|---|
| 2,528,335 | 10/1950 | Bottorf | 34/97 X |
| 3,943,329 | 3/1976 | Hlavac | 34/96 |
| 4,634,839 | 1/1987 | Gilbertson | 34/97 X |
| 4,759,135 | 7/1988 | Scivoletto | 34/97 |

*Primary Examiner*—Henry A. Bennet

*Attorney, Agent, or Firm*—Berman, Aisenberg & Platt

[57] ABSTRACT

A diffuser attachment for a hair dryer includes a perforated face plate having a diameter between 2 and 6 times that of the nozzle portion of the hair dryer to which the diffuser is attached, and a plurality of spaced apart slot portions in the sidewall of the diffuser attachment enabling unheated air to enter the diffuser attachment during use and enabling heated air to escape after use, thus avoiding overheating.

7 Claims, 3 Drawing Sheets

DIFFUSER ATTACHMENT FOR A HAIR DRYER

FIELD OF THE INVENTION

The invention relates to an air diffuser attachment for a hand-held hair dryer.

BACKGROUND OF THE INVENTION

Known diffuser attachments for hair dryers, for spreading and reducing the speed of air flow from the dryer nozzle, trap hot air and the dryer cuts off due to overheating.

Forsberg, U.S. Pat. No. 4,230,279, is directed to a diffuser attachment having a plurality of apertures on a face portion and a filter behind the face plate to provide resistance to the flow of air. The problem of overheating is not solved since there is no apparent way for cool air to enter or hot air to exit when the dryer is turned off. Barns et al., U.S. Pat. No. 4,602,146, describes a hand-held hair dryer having a nozzle portion enclosing diffuser vanes pivotally mounted within the nozzle.

The hair dryer of Hlavac, U.S. Pat. No. 3,943,329, has a diffuser section having a plurality of apertures on its face. Should the air exit on the face of the diffuser become partially or completely blocked, air flow exits through an annular space between a guard member and the nozzle. Laing, U.S. Pat. No. 3,284,611, describes a removable air deflector for a hair dryer attached by end members so that deflector members are spaced from the hair dryer casing allowing cool air to enter the deflector and mix with air leaving the dryer nozzle.

The patent to Gilbertson, U.S. Pat. No. 4,634,839, shows a handheld air dryer for use in drying small areas such as teeth, gums and mouth. The dryer has a plurality of opening exhaust vents for directing air away from the nozzle. In use, air is directed in a concentrated stream to the area to be dried.

SUMMARY OF THE INVENTION

A diffuser attachment for a hair dryer allows heated air to be gently diffused from the dryer, for drying hair without disturbing it.

A diffuser attachment for a hair dryer includes a hollow body having a portion for attaching a nozzle end of a hair dryer at one end of the hollow body, a sidewall portion for conducting heated air emitted from the nozzle of the hair dryer, and a perforated face plate portion for diffusing air at reduced velocity at the opposite end of the hollow body. The face plate portion has a substantially larger diameter than the nozzle portion, and a filter is provided behind the face plate for filtering air leaving the diffuser attachment.

Sidewalls of the diffuser attachment are perforated by a plurality of spaced apart slots, each of which optionally has a longitudinal axis parallel to the longitudinal axis of the diffuser attachment. The spaced apart slots are optionally positioned having one end adjacent the face plate portion.

An object of the invention is to provide a diffuser attachment for a hair dryer having a plurality of slots around the circumference of sidewalls thereof for intake of cool air when the diffuser attachment is in use attached to the hair dryer and for outflow of hot air to prevent overheating when the hair dryer is turned off.

DETAILED DESCRIPTION OF THE INVENTION

Figure 1:
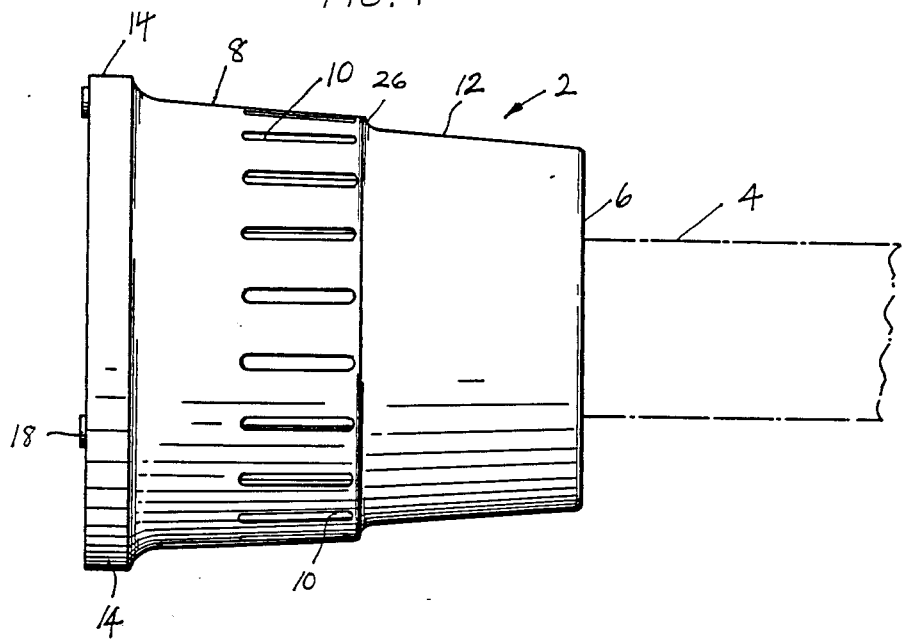
FIG. 1 is a side elevational view of a diffuser attachment of the invention.
Figure 2:
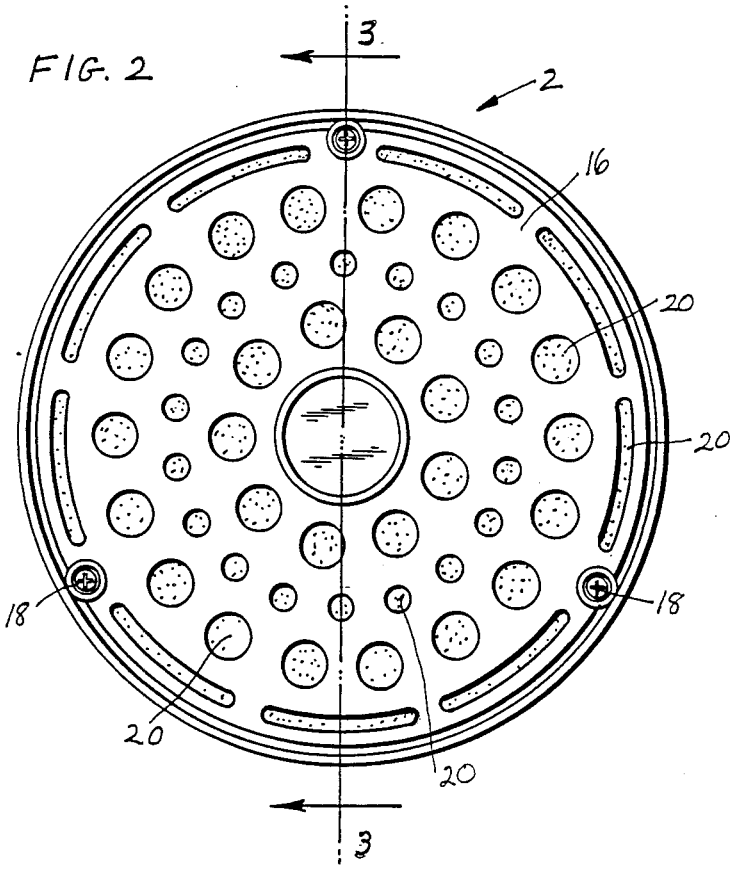
FIG. 2 is an end view of the face portion of the diffuser attachment of FIG. 1.

The diffuser attachment of the invention fits onto the nozzle portion of a hair dryer and diffuses the stream of air emitted therefrom over a large area so that air is emitted from the diffuser in a gentle stream which does not disturb the hair. Hair is substantially not blown around when using this diffuser attachment, as it is when using a regular hand-held dryer without a diffuser attachment.

Problems occur with known diffusers in that hot air tends to get trapped within the diffuser and the dryer overheats causing the motor to cut out. Using the diffuser attachment of the invention, the slots around the sidewall draw cool air into the diffuser, which is emitted with the hot air from the nozzle while the dryer is in use. The same slots serve as exhaust slots for hot air remaining in the diffuser when the hair dryer is turned off. The face plate of the diffuser is substantially larger in area than the nozzle of the hair dryer, and may, for example, have a diameter between 2 and 6 times that of the nozzle of the hair dryer.

Referring to the drawings, in which like numerals represent like parts, FIGS. 1 to 4 show diffuser attachment 2 attached to nozzle portion 4 of a hair dryer (shown in broken lines) which is inserted at inlet end 6 of diffuser attachment 2. Diffuser attachment 2 has a hollow body which is preferably circular in cross section and has an outer surface 8 forming a sidewall in which a plurality of openings, such as slots 10, are positioned. Outer surface 8 may have a portion 12 of smaller diameter and a rim portion 14 for receiving face plate 16. Face plate 16 is attached to the outlet end by means of screws 18, or other appropriate means. Face plate 16 has a plurality of perforations 20 which may be round, elongated, or other appropriate shape, of various sizes and arrangements known to one skilled in the art.

Figure 3:
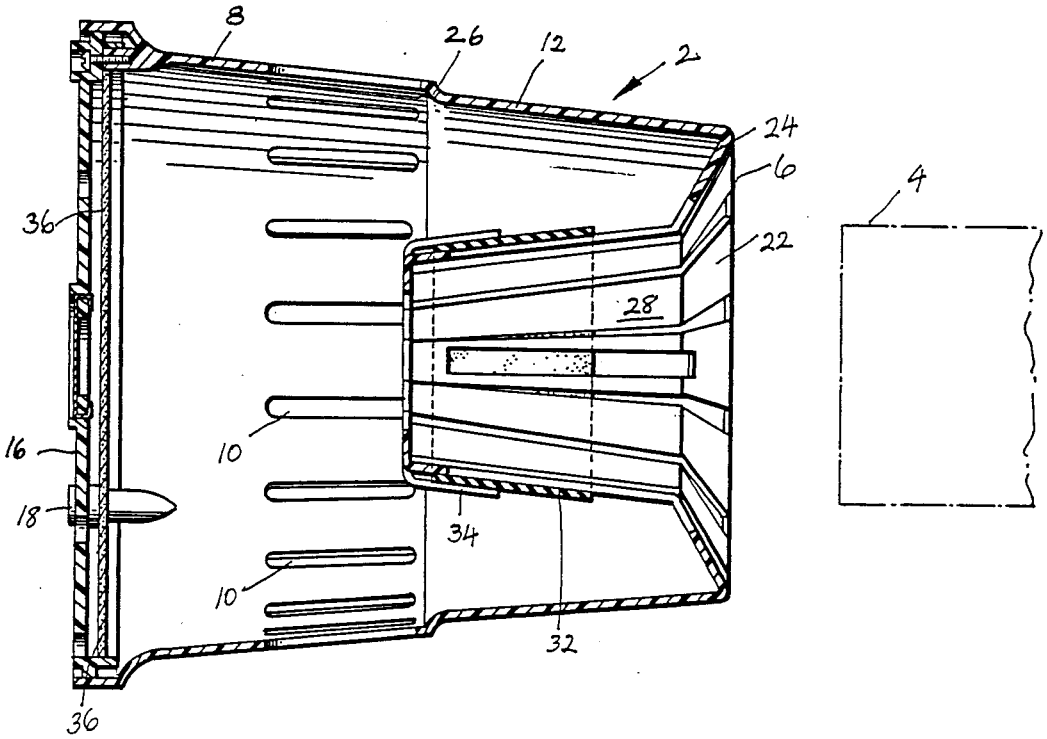
FIG. 3 is a section taken on line 3—3 of FIG. 2.
Figure 4:
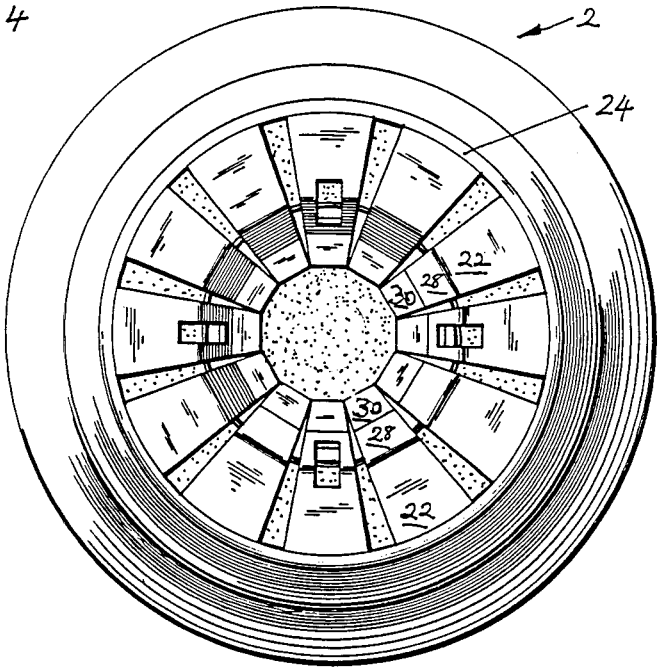
FIG. 4 is an end view of the nozzle-inserting end of the diffuser attachment of FIG. 1.

Details of end portion 6 of diffuser attachment 2 are shown in FIGS. 3 and 4. Hair dryer nozzle 4 enters a cavity in the end of diffuser attachment 2. The cavity is formed by flexible finger portions which enable the diffuser attachment to be held firmly on the hair dryer nozzle. In a non-limiting example, shown in FIGS. 3 and 4, end portions 22 of the fingers extend inwardly from the inner circumference 24 of the diffuser attachment, extending substantially diagonally a sufficient distance to form an entry passage for the hair dryer nozzle. Finger portions 28 then extend longitudinally of diffuser attachment 2. These finger portions 28 terminate in finger portions 30 each of which is substantially perpendicular to portion 28 from which it extends. Finger portions 28 are held together by resilient elastomeric retainer band 32, which may be a rubber or plastic retainer known to one skilled in the art. Clips 34 may optionally be used to hold the resilient retainer in place on the finger portions. Clips 34 are suitably formed by partially cut-out portions from finger portions 28, attached to finger portions 28 at one end.

A layer of filter material 36 is preferably located behind face plate 16 for trapping dust. Filter material 36 is preferably cellular sheet material, such as a sheet of foamed plastic.

Ventilation slots 10 extend around the sidewall of the diffuser attachment for minimizing heat buildup and reduction of back pressure in the hair dryer. The ventilation slots may optionally extend through shoulder portion 26 which separates surface portions 8 and 12 of the diffuser attachment, as shown in FIGS. 1 and 3.

Figure 5:
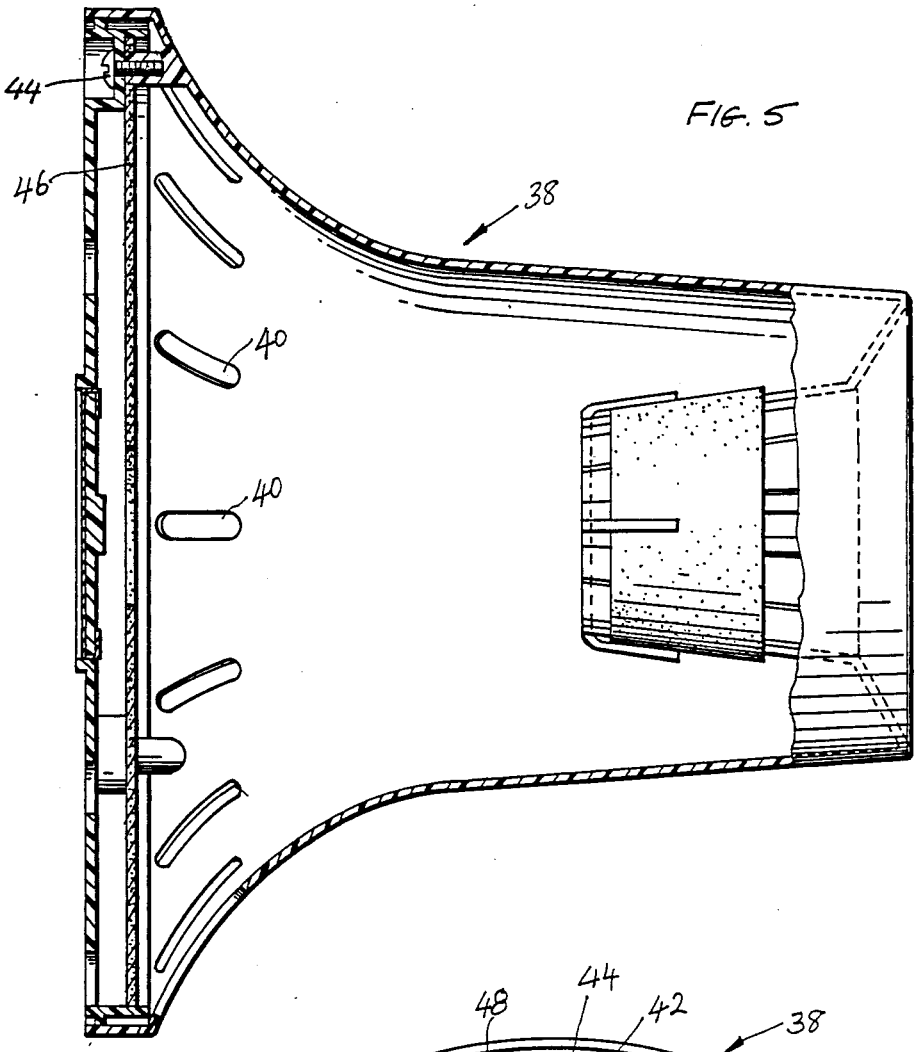
FIG. 5 is a sectional view of another embodiment of the diffuser attachment.
Figure 6:
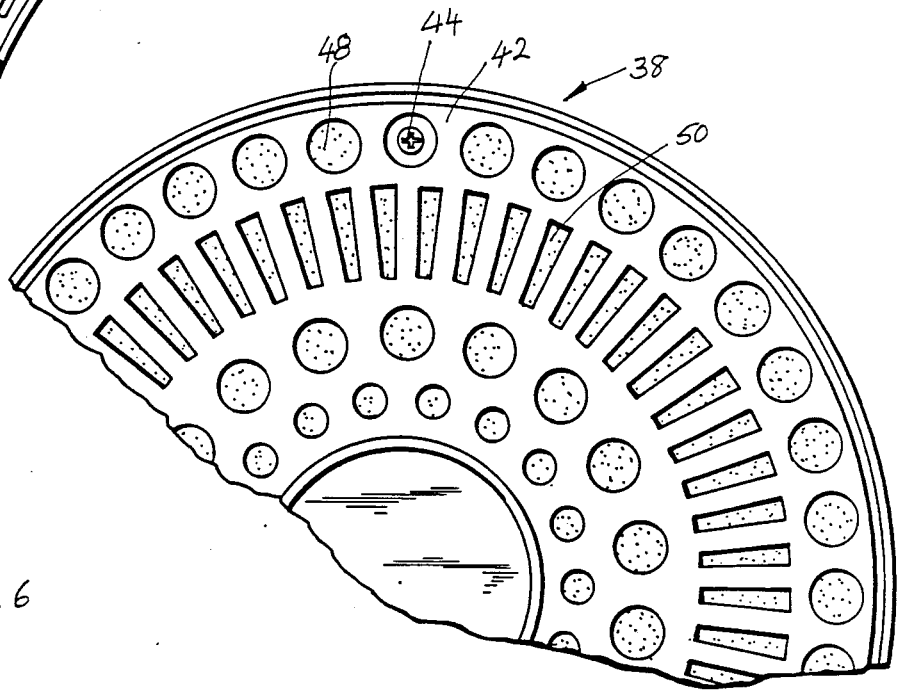
FIG. 6 is a cut-away end view of the face portion of the embodiment of FIG. 5.

An alternative embodiment of the diffuser attachment is shown in FIGS. 5 and 6, in which FIG. 5 shows a diffuser attachment 38, similar to diffuser attachment 2 (shown in FIGS. 1 to 4), wherein slots 40 are spaced apart parallel to each other around attachment 38, and substantially perpendicular and adjacent to face plate 42. Diffuser attachment 38 has a substantially cylindrical hollow body which flares out at its outlet end to meet substantially enlarged face plate 42. Face plate 42 is held in position by screws 44 and filter material 46 is positioned behind face plate 42. Ventilation holes 48 and 50, shown in FIG. 6, serve the same function as ventilation holes 20 in FIG. 2.

Ventilation slots 10 in FIGS. 1 to 4 and slots 40 in FIGS. 5 and 6 allow cold air to be pulled into the diffuser attachment, similarly to the principle employed in a jet engine or in a ducted-fan engine. The movement of the peripheral air into the diffuser attachment eliminates the reduced air flow into the outside corners of the attachment which would normally create back pressure, generally the major cause of overheating and cycling in a hair dryer.

Slots 10 and 40 further allow internally trapped hot air to vent from the diffuser attachment. When a hair dryer is shut off, the thermostat typically overshoots since air movement has ceased and the heater coil is still hot. The diffuser attachment provides a long extension to the nozzle of the dryer which, in conjunction with the diffuser structure, traps the hot air which contributes to the thermal overshoot. The peripheral slots 10 and 40 provide the necessary venting to eliminating this problem. Other locations, shapes and sizes for slots 10 and 40 in the sidewall of the diffuser will be apparent to one skilled in the art. For example, the same function can be accomplished with vent holes 10 and 40 of different shape. An elongated slot-like shape is shown as a non-limiting example, but other shapes which serve the same functional purpose may equally well be used.

Slots 10 and 40 may be positioned adjacent the face plate as shown in FIG. 5, or may be positioned in the sidewall spaced from the face plate, as shown in FIGS. 1 and 3. The location is such that it results in cool air entering the diffuser attachment and hot air exiting the attachment to prevent overheating and eliminate cycling.

In the diffuser attachment of the invention, the hollow body space between the face plate portion and the nozzle attachment portion is unobstructed, allowing free circulation of air within the hollow body of the diffuser and allowing air to flow freely through the apertures in the sidewalls of the hollow body portion.

While the invention has been described above with respect to certain embodiments thereof, it will be appreciated that variations and modifications may be made without departing from the spirit and scope of the invention.

What is claimed is:

1. A diffuser attachment for a nozzle of a hair dryer, comprising a straight hollow body portion having a face plate portion at one end, a hair dryer nozzle attachment portion at an opposite end, a sidewall portion extending therebetween, and perforation means spaced substantially symmetrically around said sidewall portion for enabling entry and exit of air, said perforation means in said sidewall portion comprising a plurality of spaced apart means for enabling unheated air to enter the diffuser attachment during use, whereby a stream of heated air flows in a straight path through the diffuser attachment and said unheated air enters the diffuser through said perforation means and surrounds the perimeter of the stream of heated air, wherein said stream of heated air surrounded by said unheated air leaves the hair dryer through the face plate portion in a stream substantially parallel to a longitudinal axis of the straight hollow body of the diffuser, flow of heated air into outside edges of the attachment adjacent the face plate portion is eliminated, and heated air escapes after use.

2. The diffuser attachment of claim 1 wherein the perforation means comprise a plurality of spaced apart longitudinal slots substantially parallel to each other.

3. The diffuser attachment of claim 2 wherein one end of each longitudinal slot is located substantially adjacent the face plate portion.

4. The diffuser attachment of claim 1 wherein the diameter of the face plate portion is between 2 and 6 times larger than the diameter of the hair dryer nozzle.

5. The diffuser attachment of claim 1 wherein the interior of said hollow body portion between the face plate portion and the nozzle attachment portion is unobstructed.

6. A diffuser attachment for a nozzle of a hair dryer comprising a straight hollow body having an outlet opening, an inlet opening spaced from said outlet opening, a sidewall portion extending between the outlet and inlet openings, and a plurality of apertures spaced substantially symmetrically around the circumference of said sidewall portion between said outlet and inlet openings and substantially adjacent said outlet opening for enabling unheated air to enter the attachment during use and for enabling said unheated air to surround the perimeter of a stream of heated air leaving the hair dryer through the outlet opening substantially parallel to the longitudinal axis of the straight hollow body, whereby back pressure caused by flow of the stream of heated air into outside edges of the attachment is eliminated.

7. The diffuser attachment of claim 5 wherein said outlet opening is substantially larger than said inlet opening.

* * * * *